US006257285B1

(12) United States Patent
Robinson et al.

(10) Patent No.: US 6,257,285 B1
(45) Date of Patent: Jul. 10, 2001

(54) DISPENSING TOOL ASSEMBLY FOR EVACUATING AND CHARGING A FLUID SYSTEM

(75) Inventors: Randy S. Robinson, Bradford; Randy S. Stemen, Lebanon, both of OH (US)

(73) Assignee: Production Control Units, Inc., Dayton, OH (US)

( * ) Notice: Subject to any disclaimer, the term of this patent is extended or adjusted under 35 U.S.C. 154(b) by 0 days.

(21) Appl. No.: 09/551,372

(22) Filed: Apr. 18, 2000

(51) Int. Cl.[7] ..... B65B 1/04

(52) U.S. Cl. ..... 141/65; 141/385; 141/59; 141/67; 141/21; 62/292; 251/149.9

(58) Field of Search ..... 141/2–5, 7, 8, 141/18, 20, 21, 59, 65, 67, 348, 349, 384–386; 62/77, 292; 251/63, 149.9

(56) References Cited

U.S. PATENT DOCUMENTS

| | | |
|---|---|---|
| Re. 34,715 | 9/1994 | Gudenau et al. . |
| 4,889,149 | 12/1989 | Weaver et al. . |
| 5,560,407 | 10/1996 | Swinford . |
| 6,029,720 * | 2/2000 | Swinford ..... 141/385 |

* cited by examiner

*Primary Examiner*—Steven O. Douglas
(74) *Attorney, Agent, or Firm*—Jacox, Meckstroth & Jenkins

(57) ABSTRACT

A fluid dispensing tool includes a three section aluminum body defining a top evacuation port and a top fluid fill port each having an annular valve seat and connected by a cross passage. Poppet valve members are supported for vertical movement between retracted open positions below the cross passage and closed positions extending upwardly through the cross passage and engaging the valve seats. The valve members are air actuated in an alternating manner with the evacuation valve member closing before the fluid valve member opens and vice versa. A center passage extends downwardly from the cross passage and through a downwardly projecting discharge spout which carries a sleeve or shuttle supporting a set of resilient sealing bands. The sealing bands are compressed axially by an air actuated piston and expand radially outwardly for sealing with a radiator fill neck above and below a port for an overflow container. The overflow container is independently filled by fluid passages extending through the tool body, and a pair of air actuated pivotal fingers are supported by the tool body for locking the tool to the radiator fill neck.

20 Claims, 3 Drawing Sheets

DISPENSING TOOL ASSEMBLY FOR EVACUATING AND CHARGING A FLUID SYSTEM

BACKGROUND OF THE INVENTION

The present invention relates to fluid dispensing tool assemblies for evacuating and charging a fluid into a fluid system and of the general type disclosed in U.S. Reissue Pat. No. RE34,715 and in U.S. Pat. Nos. 4,889,149 and 5,560,407 which issued to the assignee of the present invention. As disclosed in the '149 and '407 patents, such tool assemblies are commonly used to fill automotive-type or motor vehicle cooling systems by first evacuating the cooling system and then charging or filling the system with a predetermined volume of fluid or coolant. Since all of the air in the system is removed during the evacuation cycle, the cooling system is filled completely without residual air pockets. Preferably, the tool assembly also provides for partially filling an overflow bottle or container which is usually connected by a flexible line or hose to the fill neck of the cooling system radiator. Since the overflow bottle is not filled completely, it is not necessary to evacuate the bottle prior to filling the bottle, but preferably, the overflow bottle receives coolant or cooling fluid simultaneously while the cooling system is being evacuated and filled in order to reduce the time of the full cycle.

With any such dispensing tool assembly for evacuating and filling a cooling system, it is desirable for the tool assembly to be compact and lightweight, to be easily attached to a cooling system, and to be simple to remove and replace for servicing. It is also desirable for the tool assembly to have control valves and passages which do not restrict the flow of fluid through the tool assembly so that a high fill rate may be obtained. In addition, the tool assembly should be easily adapted for use with radiator fill necks of different sizes and to provide for partially filling an overflow container or bottle simultaneously while the cooling system is being evacuated and filled with a fluid or liquid coolant. While the charging or dispensing tool assemblies disclosed in the above mentioned patents provide some of these desirable features, none of the tool assemblies provide all of the features.

SUMMARY OF THE INVENTION

The present invention is directed to an improved dispensing tool assembly which provides all of the desirable features mentioned above and which is ideally suited for evacuating and filling the cooling systems for motor vehicles while on an assembly line for the vehicles. More specifically, the tool assembly of the invention is compact and light weight and may be quickly coupled and sealed to the fill neck of a cooling system without requiring rotational orientation. The tool assembly of the invention also provides for a substantial increase in the flow rate of fluid through the tool assembly over prior tool assemblies so that the time for completely filling a cooling system is minimized. In addition, the tool assembly of the invention may be easily and quickly removed from connected lines and hoses for servicing or replacement, and is effective to evacuate and fill the cooling system while cooling fluid is also supplied through the tool assembly to an overflow container or bottle.

In accordance with a preferred embodiment of the invention, a dispensing tool assembly includes a three section aluminum body with an upper head section defining a fluid supply port and an evacuation port each having a valve seat and connected by a laterally extending or cross chamber or passage. An intermediate body section has a center passage extending axially downwardly from the cross chamber and supports a set of poppet valves for movement on the parallel axes of the valve seats. Each of the valve members is air actuated by a double acting piston, and the valve members are constructed so that the evacuation valve member moves upwardly through the cross passage to engage its valve seat or closes before the coolant valve member moves downwardly through the cross passage to its open position.

The lower or base section of the tool body supports an axially movable tubular discharge spout forming an extension of the center passage, an annular sleeve or shuttle is slidably mounted on the discharge spout. The shuttle and spout support a set of resilient ring seals which are simultaneously compressed axially by an air actuated piston mounted on the upper end of the discharge spout and supported within the base section. The axial compression produces radial expansion of the ring seals against an upper and lower cylindrical portions of a radiator fill neck. The annular shuttle has axially extending passages which receive cooling fluid through passages within the tool body and terminate between the ring seals for simultaneously filling an overflow bottle while the cooling system is being evacuated and filled. The tool body also supports a pair of diametrically opposite lever-type locking fingers or arms which are air actuated by corresponding pistons within the head portion of the tool body.

Other features and advantages of the invention will be apparent from the following description, the accompanying drawings and the appended claims.

DESCRIPTION OF THE PREFERRED EMBODIMENT

Figure 1:
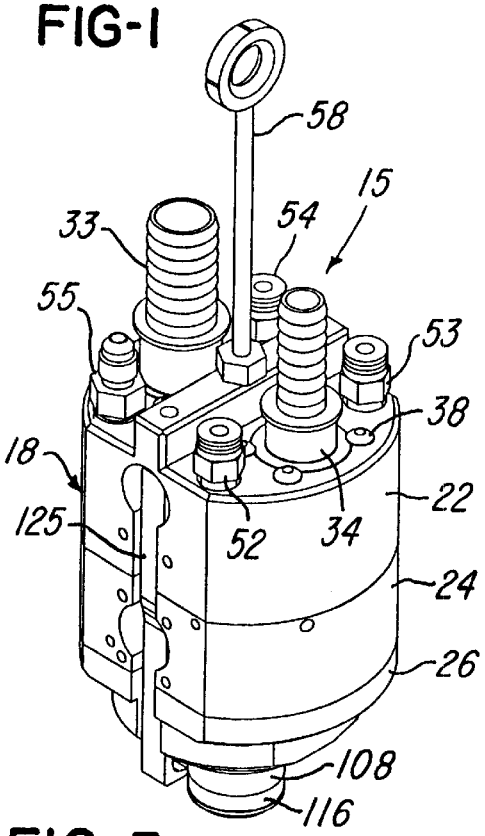
FIG. 1 is a perspective view of a dispensing tool assembly constructed in accordance with the invention.
Figure 2:
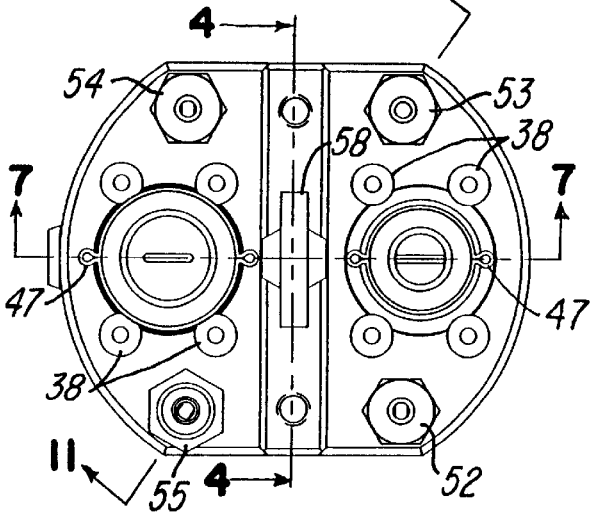
FIG. 2 is a top view of the tool assembly shown in FIG. 1.
Figure 3:
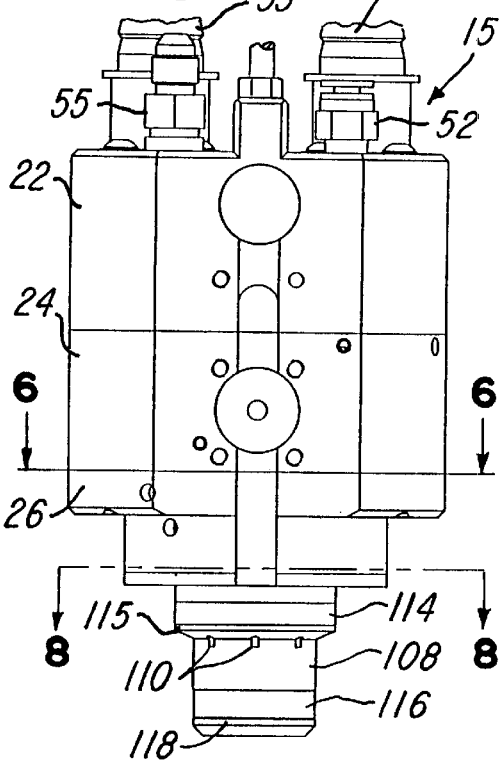
FIG. 3 is a side elevational view of the tool assembly shown in FIG. 1, with a side locking finger removed.

FIG. 1 illustrates a dispensing tool assembly 15 which includes hard coated aluminum body 18 having an upper head section 22, an intermediate section 24 and a bottom or base section 26. The head section 22 has a fluid supply passage or port 28 (FIG. 7) and an evacuation passage or port 31 which received corresponding tubular fittings 33 and 34. Each of the fittings 33 and 34 has an outwardly projecting flange 36 which is secured to the top of the head section 22 by a set of four screws 38 (FIG. 2) each having a hexagonal recess. A pair of resilient O-ring seals 41 (FIG. 7) form a fluid-tight seal between each fitting 33 and 34 and the head body section 22, and the upper portion of each fitting 33 and 34 has axially spaced ribs for forming a seal with a flexible fluid supply hose 43 (FIG. 7) and a flexible suction or evacuation hose 45, respectively. Crimp-type hose clamps 47 secure the flexible hoses 43 and 45 to the corresponding fittings 33 and 34.

A set of tubular coupler fittings 52, 53, 54 and 55 are threaded into tapped ports formed within the top of the body section 22, and the quick connect fittings 52, 53 and 54 are connected to corresponding flexible air pressure lines or tubes (not shown) which control the operation of the tool assembly 15. The fitting 55 connects with a flexible cooling fluid or coolant supply line (not shown) for partially filling an overflow bottle or container, as will be explained later. The fluid supply hose 43, the evacuation hose 45 and the air pressure control lines connected to the fittings 52, 53 and 54 and the fluid supply tube connected to the fitting 55 all extend from a machine produced by the assignee of the present invention and used with the tool assembly 15 for automatically evacuating and charging or filling an engine cooling system and also an optional overflow container or bottle. In use, the tool assembly 15 is normally suspended by a counterbalancing device having a cable connected to an eyebolt 58 threaded into the head body section 22. The counterbalancing device suspends the tool assembly 15 so that it may be easily and quickly raised and lowered and maneuvered by an operator's hand for connecting the tool assembly 15 to a cooling system and for removing the tool assembly from the cooling system.

Figure 7:
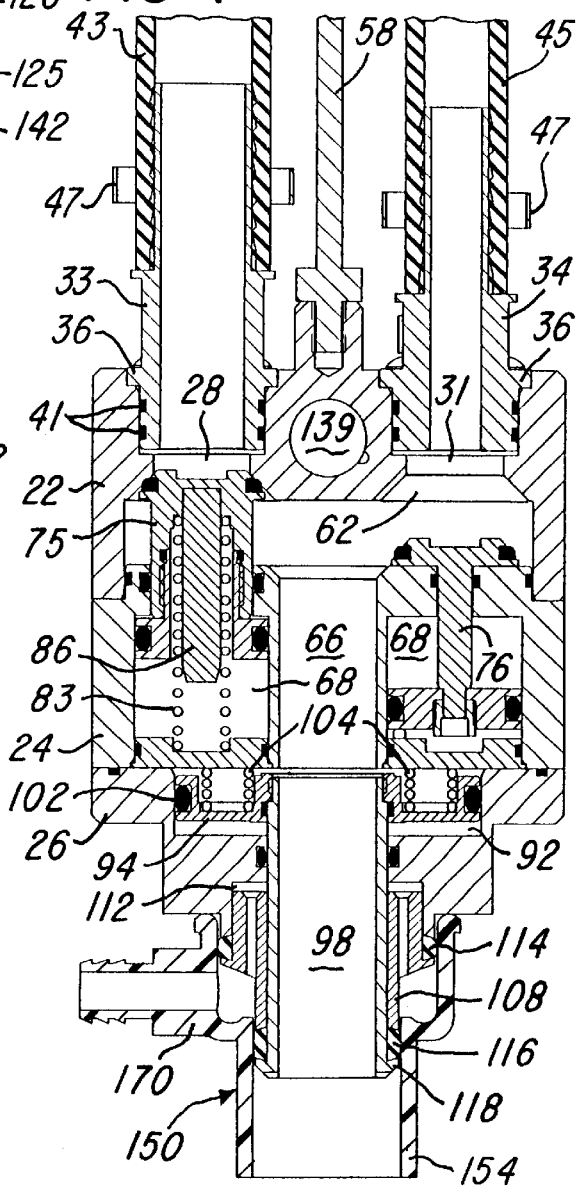
FIG. 7 is an axial section taken generally on the line 7—7 of FIG. 2 and showing the tool assembly in the evacuation cycle.
Figure 9:
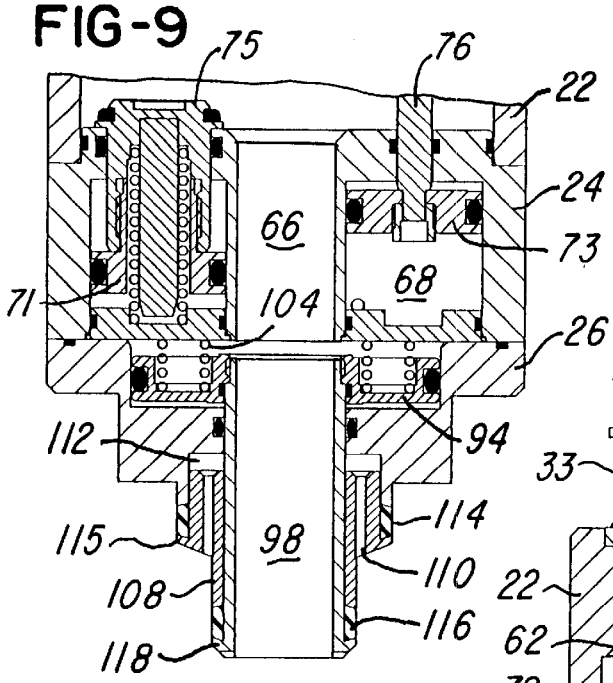
FIG. 9 is a fragmentary axial section of the tool assembly as shown in FIG. 7 but before inserting into a radiator fill neck.
Figure 10:
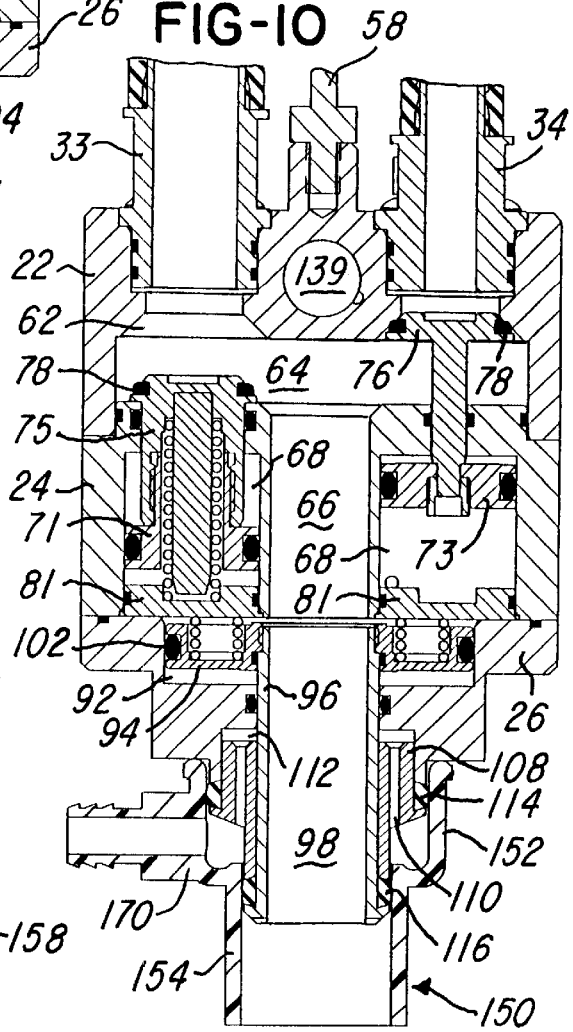
FIG. 10 is an axial section similar to FIG. 7 and showing the tool assembly in the fluid or coolant filling cycle.

Referring to FIGS. 7, 9 and 10, each of the ports 28 and 31 has a frusto-conical valve seat 62 formed within the head section 22 of the body 18, and the body section 22 also forms a laterally extending or cross chamber or passage 64 which connects the ports 28 and 31. As also shown in FIG. 7, the intermediate body section 24 has a center bore or passage 66 which extends axially from the cross passage 64. The body section 24 also defines a pair of diametrically opposite air chambers 68 which support corresponding piston 71 and 73 for axial or vertical movement on the parallel axes of the valve seats 62. The piston 71 is connected to a fluid control poppet valve member 75, and the piston 73 is connected to an evacuation poppet valve member 76. Each of the valve members 75 and 76 has a head portion which carries a resilient O-ring or ring seal 78 which forms a fluid-tight seal with its corresponding valve seat 62 when the valve member is extended upwardly through the cross passage 64.

The bottom end of each cylindrical bore or air chamber 68 is closed by a retaining plug 81, and a fail safe compression spring 83 extends from the left retaining plug 81 (FIGS. 7 & 10) into the fluid control poppet valve member 75 around a cylindrical guide pin 86. A set of resilient O-ring seals form sliding fluid-tight seals for the piston 71 and valve member 75 and 76, and other resilient O-ring seals form air-tight seals for the closure plugs 81. Referring to FIGS. 7 and 10, the fluid control poppet valve member 75 moves between an upper closed position (FIG. 7) and a lower open position (FIG. 10), and the evacuation valve member 76 moves from its open position (FIG. 7) to its closed position (FIG. 10) in response to the supply of pressurized air to the cylinder chamber 68 on opposite sides of the pistons 71 and 73. When pressurized air is supplied to the fitting 52 (FIG. 1), the pressurized air is directed by internal passages to both chambers 68 above the piston 73 and below the piston 71 so that the evacuation valve member 76 opens, and the fluid supply valve member 75 closes (FIG. 7). When pressurized air is supplied to the fitting 54 the air is directed by internal passages to both chambers 68 below the piston 73 (FIG. 10) and above the piston 71 so that evacuation valve member 76 is closed and the fluid supply valve member 75 is opened. Since the air pressure is exerted against the bottom of the piston 73 and its full circular area and only against an annular area on top of the piston 71 (FIG. 10), the evacuation valve member 76 closes before the fluid supply valve member 75 opens to assure that none of the supply fluid is sucked by vacuum through the cross passage 64 into the evacuation hose 45.

Figure 6:
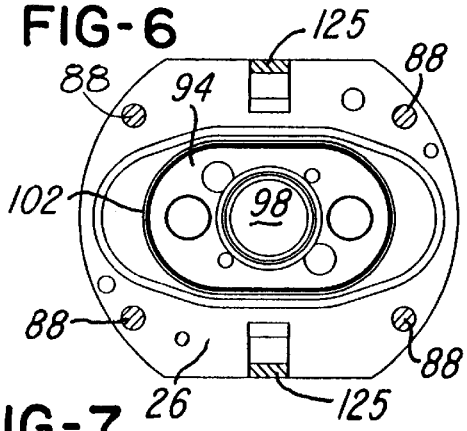
FIG. 6 is a section taken generally on the line 6—6 of FIG. 3.
Figure 11:
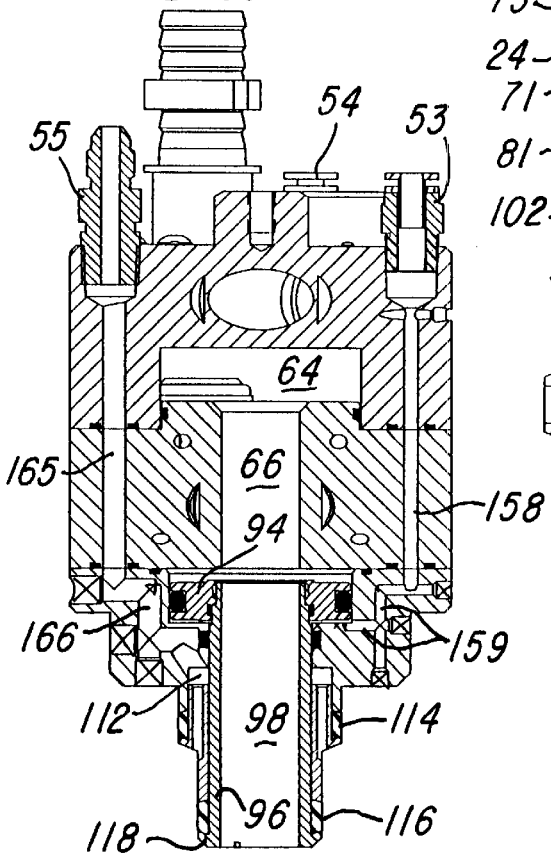
FIG. 11 is a slightly reduced section taken generally on the line 11—11 of FIG. 2.

The bottom or base section 26 of the tool body 18 is coupled to the head section 22 and intermediate section 24 by a set of axially extending screws 88, and resilient O-rings (shown in black) form fluid-tight seals around the various fluid and air passages at the interfaces or junctions of the body sections 22, 24 and 26. Referring to FIGS. 6, 10 and 11, the base section 26 has an oval-shaped air chamber 92 which receives an annular oval-shaped piston 94 for vertical or axial movement. The piston 94 is mounted on the upper end portion of a cylindrical or tubular discharge spout 96 which defines a cylindrical center passage 98 having the same diameter and aligned with the center passage 66 within the intermediate body section 24. An oval-shaped resilient O-ring 102 surrounds the piston 94 and forms a fluid-tight sliding seal with the body section 26. A pair of compression springs 104 (FIGS. 7 & 10) are confined within bores within the oval piston 94 and engage the retainer plugs 81 for normally urging the piston 94 and tubular spout 96 downwardly to the position shown in FIGS. 4 and 9.

Figure 8:
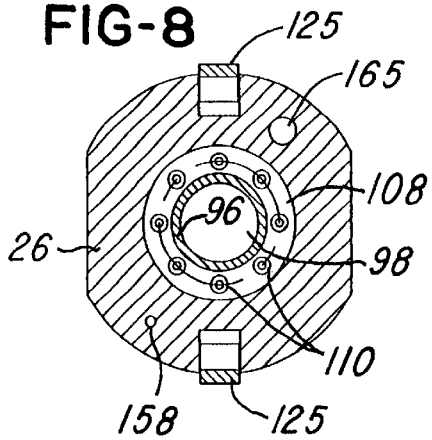
FIG. 8 is a section taken generally on the line 8—8 of FIG. 3.

An annular sleeve or shuttle 108 is mounted on the discharge spout 96 for sliding axial movement and before the spout is attached to the oval piston 94. As shown in FIGS. 7 & 8, the shuttle 108 has a series of circumferentially spaced and axially extending holes or passages 110 having upper ends connected by a counterbore 112 formed within the bottom portion of the body section 26. Referring to FIG. 9, an annular resilient band seal 114 is mounted on the annular shuttle 108 above an outwardly projecting flange 115, and a smaller diameter resilient band seal 116 is mounted on a bottom flange portion 118 of the tubular spout 96 below the bottom end surface of the sleeve 108. The opposite end surfaces of each of the band seals 114 and 116 are tapered and mate with corresponding tapered annular surfaces on the body section 26, sleeve 108 and bottom flange 118 of the spout 96 so that the seals 114 and 116 are captured in the positions shown in FIG. 9 when the seals are in their released positions, but are easily removable.

Figure 4:
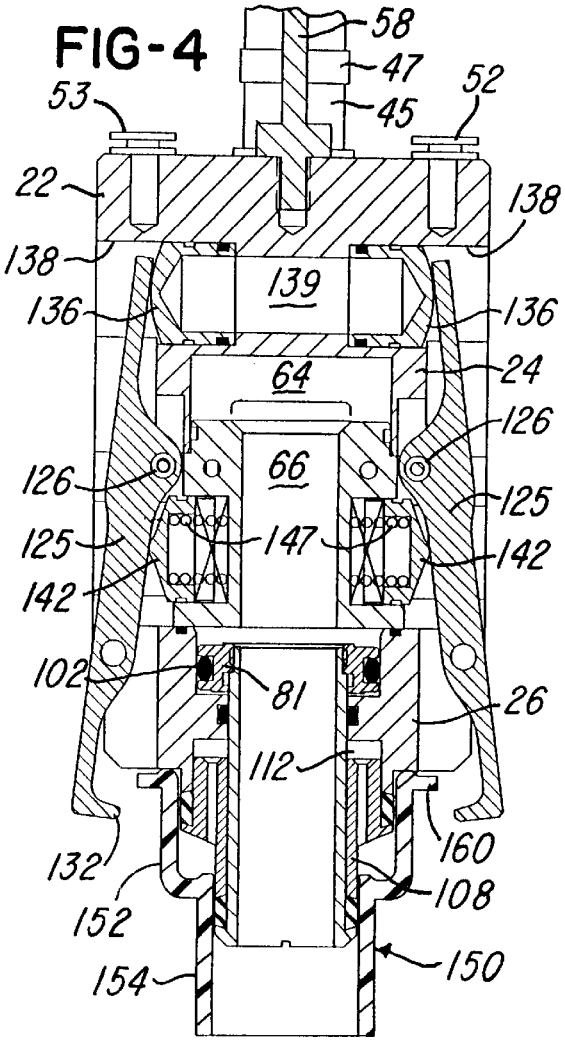
FIG. 4 is an axial section taken generally on the line 4—4 of FIG. 2 and with the tool assembly being installed on a radiator fill neck.
Figure 5:
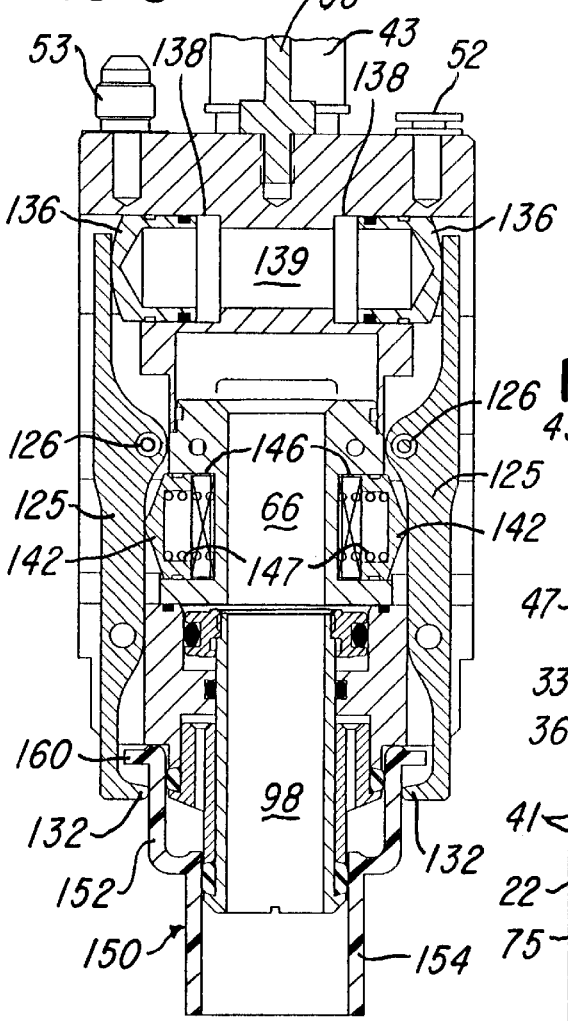
FIG. 5 is an axial section similar to FIG. 4 and showing the tool assembly sealed to and locked on the radiator fill neck.

Referring to FIGS. 4 and 5, a pair of lever-type locking arms or fingers 125 are pivotally supported by cross pins 126 within corresponding diametrically opposed slots formed within the body 18. The fingers 126 have hook-shaped lower end portions 132 which project inwardly towards the upper band seal 114. A pair of air-actuated pistons 136 (FIGS. 4 and 5) are supported for axial movement in corresponding counterbores 138 formed within the head section 22 of the body 18 in diametrically opposed relation, and the pistons 136 engage the upper end portions of the pivotal arms or fingers 125. An air chamber or passage 139 connects the counterbores 138 and is connected to receive pressurized air by an internal passage connected to the fitting 53 (FIG. 1).

Another set of pistons 142 are supported within corresponding cylindrical bores or chambers 146 and have outer tip portions which engage the locking fingers or arms 125 below the pivot pins 126. A compression spring 147 and a surrounding wave spring are confined within each of the bores 146 for normally urging the pistons 142 outwardly and the locking arms 125 to their normally released positions, shown in FIG. 4.

When it is desired to evacuate and then fill an engine cooling system having a radiator with a fill neck 150 (FIGS. 4, 5, 7 and 10), the tool assembly 15 is lowered until the base section 26 of the body 18 seats on a top rim of the fill neck 150 and the sealing rings or bands 114 and 116 are received within corresponding cylindrical portions 152 and 154 of the fill neck 150, as shown in FIG. 4. The air line connected to the fitting 53 is then pressurized so that pressurized air is directed downwardly through a vertical passage 158 (FIG. 11) and through connecting passages 159 to the oval chamber 92 below the oval piston 95. The air pressure forces the piston and the tubular spout 96 upwardly so that both of the resilient seals 114 and 116 are compressed simultaneously and with equal pressure in an axial direction causing the seals to expand radially outwardly to engage and seal with the corresponding cylindrical portions 152 and 154 of the fill neck 150.

The pressurized air within the passage 158 (FIG. 1 1) is also directed by a passage into the chamber 139 so that both of the pistons 136 are pressurized outwardly. The outward pressure on the upper end portions of the fingers or arms 125 causes them to pivot against the biasing springs and pistons 142 until the bottom tabs or end portions 132 of the arms 125 shift inwardly under a top flange 160 of the fill neck 150. The dispensing tool 15 is thereby locked onto the fill neck 150 and is prevented from blowing off in the event the seals 114 and 116 did not adequately engage and seal with the fill neck 150. As apparent, when the pressurized air within the passage 158 and below the piston 94 is released, the compression springs 104 return the piston and the tubular spout 96 downwardly to the positions shown in FIG. 4 where the axial compression on the ring seals 114 and 116 it released so that the seals are no longer compressed against the fill neck 150. The releasing of the pressurized air within the passage 158 also releases the pressure against the pistons 136 so that the locking fingers or arms 125 return to their normal positions, as shown in FIG. 4.

After the tool assembly 15 is sealed and locked to the fill neck 150 by pressurized air through the fitting 53, pressurized air is supplied to the fitting 52, and the pressurized air is directed by internal passages to the bottom of the piston 71 and the top of the piston 73. This causes the evacuation valve member 76 to open (FIG. 7) and the fluid-fill valve member 75 to remain closed. The suction in the line or hose 45 is then effective to evacuate air from the cooling system through the passage 98 defined by the spout 96. After the system is evacuated, pressurized air to the fitting 52 is shut off, and pressurized air is supplied to the fitting 54, and the pressurized air is directed by the internal passages to the bottom of the piston 73 and to the top of the piston 71. This causes the evacuation valve member 76 to close after which the fluid valve member 75 opens as a result of the differential area between the bottom of the piston 73 and the top of the piston 71.

When the valve member 75 opens, the fluid or coolant is directed into the passages 64, 66 and 98 (FIG. 10) in order to fill the cooling system completely with a predetermined volume or charge of cooling fluid or coolant. While fluid is being supplied through the tool assembly 15 to fill the cooling system, the cooling fluid is also supplied through the fitting 55 and a passage 165 (FIG. 11) and through passages 166 to the annual chamber 112 above the annular sleeve or shuttle 108. The fluid flows downwardly through the passages 110 within the shuttle 108 and radially outwardly through a fill neck fitting 170 connected by a flexible tube to an overflow bottle or container. Since the overflow container is not completely filled with cooling fluid or coolant, only a predetermined volume of fluid is supplied through the fitting 55 as controlled by the remote evacuation and fluid charging machine.

From the drawings and the above description, it is apparent that a dispensing tool assembly constructed in accordance with the present invention, provides desirable features and advantages. As one important advantage, the arrangement of the fluid valve member 75 and the evacuation valve member 76 with respect to the laterally extending chamber or passage 64 connecting the ports 28 and 31, provides for an unrestricted high flow rate of air during the evacuation of the cooling system, as shown in FIG. 7, and an unrestricted high flow rate of fluid through the tool assembly, as shown in FIG. 10. The tool assembly 15 is also compact, light weight, simple in construction and easy to maintain.

The base section 26 of the body 18 and the components supported by the base section may also be easily replaced and interchanged with other base section sub-assemblies for accommodating radiator fill necks of different sizes. The expanding resilient seals 114 and 116 are also adaptable for accommodating fill necks 150 of different sizes and are effective to secure and seal the tool assembly 50 to the fill neck without requiring rotational orientation of the tool assembly. As another feature, the connection of the fluid fill hose 43 and evacuation hose 45 to the tool body 18 with the fittings 33 and 34 and the sets of screws 38, provide for quickly and conveniently removing the fittings 33 and 34 from the tool body 18 to minimize the time required for interchanging tool assemblies or for removing a tool assembly for servicing.

The floating sleeve or shuttle 108 provides for uniform compression and expansion of the seals 114 and 116 against the radiator fill neck 150, and the resilient seals 114 and 116 may also be easily and quickly replaced if either seal becomes worn or damaged. The dual seals and passages 110 also provide for filling the overflow bottle or container simultaneously while the cooling system is being evacuated and filled. This simultaneous filling cooperates to minimize the overall cycle time for charging a cooling system including the overflow bottle or container. As mentioned above, the valve members 75 and 76 operate in a delayed alternating manner in response to supplying pressurized air to either the fitting 52 or the fitting 54, and the evacuation valve member 76 is assured of being closed before the fluid valve member 75 opens. Also, the fluid valve member 75 is assured of being closed before the evacuation valve member 76 opens. Thus none of the cooling fluid entering the port 28 can short circuit through the cross passage 64 into the evacuation port 31. In addition, the fail safe compression spring 83 assures that the valve member 75 remains closed in the event of loss of pressurized air to the tool assembly.

While the method and form of dispensing tool herein described constitute a preferred embodiment of the invention, it is to be understood that the invention is not limited to the precise method and form of tool described, and that changes may be made therein without departing from the scope and spirit of the invention as defined in the appended claims.

What is claimed is:

1. An improved dispensing tool assembly adapted to be releasably connected to a fluid system for first evacuating the system and then filling the system with a charge of fluid, said tool assembly comprising a body defining an evacuation port adapted to be connected to a suction line and a fluid inlet port adapted to be connected to a source of fluid, said ports each having an annular valve seat and connected by a laterally extending passage within said body, a fluid valve member opposing said valve seat for said fluid inlet port and an evacuation valve member opposing said valve seat for said evacuation port, said valve members supported for generally parallel movement between retracted open positions on one side of said laterally extending passage and closed positions extending through said laterally extending passage and engaging said valve seats, said body having a fluid discharge spout cooperating to define a discharge passage extending from said laterally extending passage, and a coupling system for releasably connecting and sealing said discharge spout to the fluid system.

2. A tool assembly as defined in claim 1 wherein said valve members are operated by corresponding air-actuated pistons, and said pistons are constructed to provide for closing said evacuation valve member prior to opening said fluid valve member in response to receiving the same air pressure.

3. A tool assembly as defined in claim 2 wherein said pistons are double-acting, and the effective area of said piston for closing said evacuation valve member is greater than the effective area of said piston for opening said fluid valve member.

4. A tool assembly as defined in claim 1 wherein said coupling system includes an annular shuttle mounted on said discharge spout and cooperating to support a set of resilient annular sealing members, and an air actuated piston for producing relative axial movement between said shuttle and said discharge spout for simultaneously compressing said resilient sealing members axially to produce simultaneous radial expansion of said sealing members.

5. A tool assembly as defined in claim 4 wherein said annular shuttle has a plurality of generally axially extending passages terminating between said resilient sealing members, and said body has a fluid passage extending to said shuttle to provide for filling a fluid overflow container connected to a fill neck of a radiator cooling fluid system.

6. A tool assembly as defined in claim 4 wherein said resilient sealing members have beveled annular end surfaces cooperating with beveled annular shoulders on said shuttle and said discharge spout for retaining said resilient sealing members.

7. A tool assembly as defined in claim 1 and including a set of tubular fittings extending into said evacuation port and said fluid inlet port, resilient sealing rings disposed between said body and said fittings, each of said fittings having an outwardly projecting flange, and a plurality of threaded fasteners securing said flange of each said fitting to said body.

8. A tool assembly as defined in claim 1 wherein said body pivotally supports a pair of diametrically opposed locking fingers each having a hook-shaped lower end portion adapted to project under a flange of a fill neck of the fluid system, and said body supports a pair of diametrically opposed air-activated pistons for pivoting said fingers to locking positions.

9. A tool assembly as defined in claim 8 wherein said body supports a pair of compression springs positioned for normally urging said fingers outwardly to released positions.

10. A tool assembly as defined in claim 1 wherein said body comprises a head section defining said evacuation port and said fluid inlet port and said laterally extending passage, an intermediate section supporting said valve members for said generally parallel movement and defining a portion of said discharge passage, and a base section supporting said discharge spout defining a remaining portion of said discharge passage.

11. A tool assembly as defined in claim 10 wherein said discharge spout supports an annular shuttle for relative axial movement, a set of axially spaced resilient sealing members mounted on said shuttle, and said base section supports an annular piston connected to move said discharge spout within said shuttle for simultaneously compressing said sealing members.

12. An improved dispensing tool assembly adapted to be releasably connected to a fluid system for first evacuating the system and then filling the system with a charge of fluid, said tool assembly comprising a body defining an evacuation port adapted to be connected to a suction line and a fluid inlet port adapted to be connected to a source of fluid, an air-actuated valve system for opening and closing said evacuation port and said fluid inlet port, said body having a fluid discharge spout cooperating to define a discharge passage extending from said valve system, a coupling system for releasably connecting and sealing said discharge spout to the fluid system, said coupling system including an annular shuttle mounted on said discharge spout for axial movement and cooperating to support a set of resilient annular sealing members, and an air actuated piston for producing relative axial movement between said shuttle and said discharge spout for simultaneously compressing said resilient sealing members axially to produce simultaneous radial expansion of said sealing members.

13. A tool assembly as defined in claim 12 wherein said annular shuttle has a plurality of generally axially extending passages terminating between said resilient sealing members, and said body has a fluid passage extending to said shuttle to provide for filling a fluid overflow container connected to a fill neck of a radiator cooling fluid system.

14. A tool assembly as defined in claim 12 wherein said resilient sealing members have beveled annular end surfaces cooperating with beveled annular shoulders on said shuttle and said discharge spout for retaining said resilient sealing members.

15. A tool assembly as defined in claim 12 and including a set of tubular fittings extending into said evacuation port and said fluid inlet port, resilient sealing rings disposed between said body and said fittings, each of said fittings having an outwardly projecting flange, and a plurality of threaded fasteners securing said flange of each said fitting to said body.

16. A tool assembly as defined in claim 12 wherein said body comprises a head section defining said evacuation port and said fluid inlet, an intermediate section supporting said valve system, a base section supporting said discharge spout, and said base section supports an annular piston connected to move said discharge spout within said shuttle for simultaneously compressing said sealing members.

17. An improved dispensing tool assembly adapted to be releasably connected to a fluid system for first evacuating the system and then filling the system with a charge of fluid, said tool assembly comprising a body defining an evacuation port adapted to be connected to a suction line and a fluid inlet port adapted to be connected to a source of fluid, an air actuated valve system for opening and closing said evacuation port and said fluid inlet port, a set of tubular fittings extending into said evacuation port and said fluid inlet port, resilient sealing rings disposed between said body and said fittings, each of said fittings having an outwardly projecting flange, a plurality of threaded fasteners securing said flange of each said fitting to said body, said body having a fluid discharge spout cooperating to define a discharge passage extending from an internal passage connected to said ports, and a coupling system for releasably connecting and sealing said discharge spout to the fluid system.

18. A tool assembly as defined in claim 17 wherein said coupling system includes an annular shuttle mounted on said discharge spout and cooperating to support a set of resilient annular sealing members, and an air actuated piston for producing relative axial movement between said shuttle and said discharge spout for simultaneously compressing said resilient sealing members axially to produce simultaneous radial expansion of said sealing members.

19. A tool assembly as defined in claim 18 wherein said annular shuttle has a plurality of generally axially extending passages terminating between said resilient sealing members, and said body has a fluid passage extending to said shuttle to provide for filling a fluid overflow container connected to a fill neck of a radiator cooling fluid system.

20. A tool assembly as defined in claim 18 wherein said resilient sealing members have beveled annular end surfaces cooperating with beveled annular shoulders on said shuttle and said discharge spout for retaining said resilient sealing members.

* * * * *